US006181073B1

(12) United States Patent
Branham

(10) Patent No.: US 6,181,073 B1
(45) Date of Patent: Jan. 30, 2001

(54) PIEZOELECTRIC ILLUMINATION CONTROL FOR MICROSCOPE

(75) Inventor: Mark Branham, Orchard Park, NY (US)

(73) Assignee: Leica Microsystems Inc., Depew, NY (US)

( * ) Notice: Under 35 U.S.C. 154(b), the term of this patent shall be extended for 0 days.

(21) Appl. No.: 09/326,059

(22) Filed: Jun. 4, 1999

(51) Int. Cl.[7] ..... H05B 37/02

(52) U.S. Cl. ..... 315/209 PZ; 315/276; 315/310

(58) Field of Search ..... 315/209 PZ, 276, 315/283, 284, 289, DIG. 1, DIG. 4, 291, 307, 310, 311; 323/355, 370

(56) References Cited

U.S. PATENT DOCUMENTS

| | | | | |
|---|---|---|---|---|
| 3,736,446 | | 5/1973 | Berlincourt et al. | 310/8 |
| 3,764,848 | | 10/1973 | Berlincourt | 315/55 |
| 3,980,921 | * | 9/1976 | Izawa | 315/206 |
| 4,025,817 | * | 5/1977 | Wollschleger | 315/209 PZ |
| 5,134,345 | * | 7/1992 | El-Hamamsy et al. | 315/247 |
| 5,229,680 | | 7/1993 | Sato et al. | 310/339 |
| 5,675,208 | | 10/1997 | Huang et al. | 310/360 |
| 5,739,679 | * | 4/1998 | Takehara et al. | 323/299 |
| 5,856,728 | | 1/1999 | Zimnicki et al. | 315/209 TZ |

* cited by examiner

*Primary Examiner*—Don Wong
*Assistant Examiner*—Thuy Vinh Tran
(74) *Attorney, Agent, or Firm*—Simpson, Simpson & Snyder, L.L.P.

(57) ABSTRACT

A piezoelectric illumination control circuit for a microscope comprising a tunable frequency source of alternating current, a piezoelectric crystal having an impedance dependent on operating frequency, driven by the tunable frequency source of alternating current, and a load driven by the piezoelectric crystal. A second embodiment comprises a piezoelectric illumination control circuit for a microscope, comprising a constant frequency source of alternating current, a piezoelectric crystal coupled to a tunable dummy reactive load for the purpose of varying the impedance of the crystal and dummy load, the piezoelectric crystal driven by the constant frequency source of alternating current, and a load driven by the piezoelectric crystal.

23 Claims, 5 Drawing Sheets

PIEZOELECTRIC ILLUMINATION CONTROL FOR MICROSCOPE

FIELD OF THE INVENTION

This invention relates generally to microscopes, more particularly to a piezoelectric device for controlling illumination in microscopes, and, even more specifically, to an illumination control circuit comprising a lithium niobate crystal.

BACKGROUND OF THE INVENTION

The illumination system is a very important part of a microscope. In fact, the full potential of any optical microscope can only be achieved if the microscope is equipped with the proper kind of illumination system. Specimen illumination also affects operator comfort and efficiency.

It is difficult to determine the best illumination system to achieve optimum illumination, since this depends both on the nature of the specimen to be examined and the type, structure and design of the microscope. For example, the illumination problem is compounded in the case of a stereo microscope, which embodies two separate and complete microscopes. No single illumination system is suitable for examining all types of specimens. Often, different illumination systems are used with the same microscope for different types of specimens. Almost always, there is an optimum illumination system for a particular system.

Various types of illumination systems are known, including, but not limited to the following: Nicholas illuminator, general purpose illuminator, fluorescent illuminator, reflector illuminator, ring illuminator, spot illuminator, coaxial illuminator, eyepiece illuminator, fiber optic annular illuminator, fiber optic bifurcated illuminator, fiber optic four-point illuminator, critical illuminator, and Koehler illuminator. Regardless of the type of illuminator, they all have one thing in common - an illumination element. Some use incandescent lamps, others fluorescent lamps, and some use fiber optics. It is often necessary and/or preferable to vary the intensity of the illumination provided by the light source. Often, this is accomplished by varying the voltage applied to the illumination element by way of an electrical rheostat. Unfortunately, rheostats are relatively expensive and can be bulky.

There is a need, then, for a device for controlling illumination in microscopes and in other devices which does not require an expensive, bulky electrical rheostat.

SUMMARY OF THE INVENTION

The invention broadly comprises a piezoelectric illumination control circuit for a microscope, comprising a tunable frequency source of alternating current, a piezoelectric crystal having an impedance dependent on operating frequency, driven by the tunable frequency source of alternating current, and, a load driven by the piezoelectric crystal. A second embodiment comprises a piezoelectric illumination control circuit for a microscope, comprising a constant frequency source of alternating current, a piezoelectric crystal coupled to a tunable dummy reactive load for the purpose of varying the impedance of the crystal and dummy load, the piezoelectric crystal driven by the constant frequency source of alternating current, and, a load driven by the piezoelectric crystal. Although a preferred embodiment of the invention is intended for use in controlling intensity of lamps in microscopes, the circuit of the invention can be used to control loads in other circuits as well.

A primary object of the invention is to provide an economical and efficient circuit for controlling the intensity of a lamp in a microscope.

A secondary object of the invention is to provide a replacement for a rheostat in a microscope.

Another object of the invention is to provide a replacement for both a step-down transformer and a rheostat in an illumination control circuit for a microscope.

A further object of the invention is to provide a replacement for a ballast in a microscope containing a fluorescent lamp.

These and other objects, features and advantages of the present invention will become readily apparent to those having ordinary skill in the art from the follow detailed description of the invention in view of the drawings and appended claims.

DETAILED DESCRIPTION OF THE PREFERRED EMBODIMENT

At the outset, it should be understood that the present invention, in a preferred embodiment, is intended as a replacement for a ceramic rheostat in a microscope. Ceramic rheostats are commonly used in microscope power supply circuits to control illumination elements. Unfortunately, rheostats are relatively expensive and break down more often than solid state devices. The present invention eliminates the ceramic rheostat and replaces it with a solid state piezoelectric material. Although a wide variety of piezoelectric materials exist which could be used for this purpose, in a preferred embodiment, a lithium niobate crystal was selected due to its high coupling coefficient and ease of availability.

The fundamental concept of a first embodiment of this invention involves the relationship of the driving frequency of the electrical power supply to the resonant frequency of the piezoelectric device. When the driving frequency of the source is tuned to the resonant frequency of the crystal, the impedance of the crystal is minimized, resulting in a maximum voltage drop across the illuminator or lamp component. As the driving frequency varies above or below the resonant frequency of the piezoelectric crystal, the crystal impedance increases, and the corresponding voltage drop across the load decreases, reducing the illumination produced by the lamp.

In a second embodiment, a constant drive frequency is applied to the crystal, but the impedance of the crystal is made variable by a coupled tunable dummy load. Ideally, the drive frequency is set to equal the known resonant frequency of the crystal. The dummy load is reactive, and may be either capacitive or inductive. By varying the dummy load, the impedance of the crystal/dummy load combination is varied, thereby varying the voltage applied to the lamp load.

Figure 1:
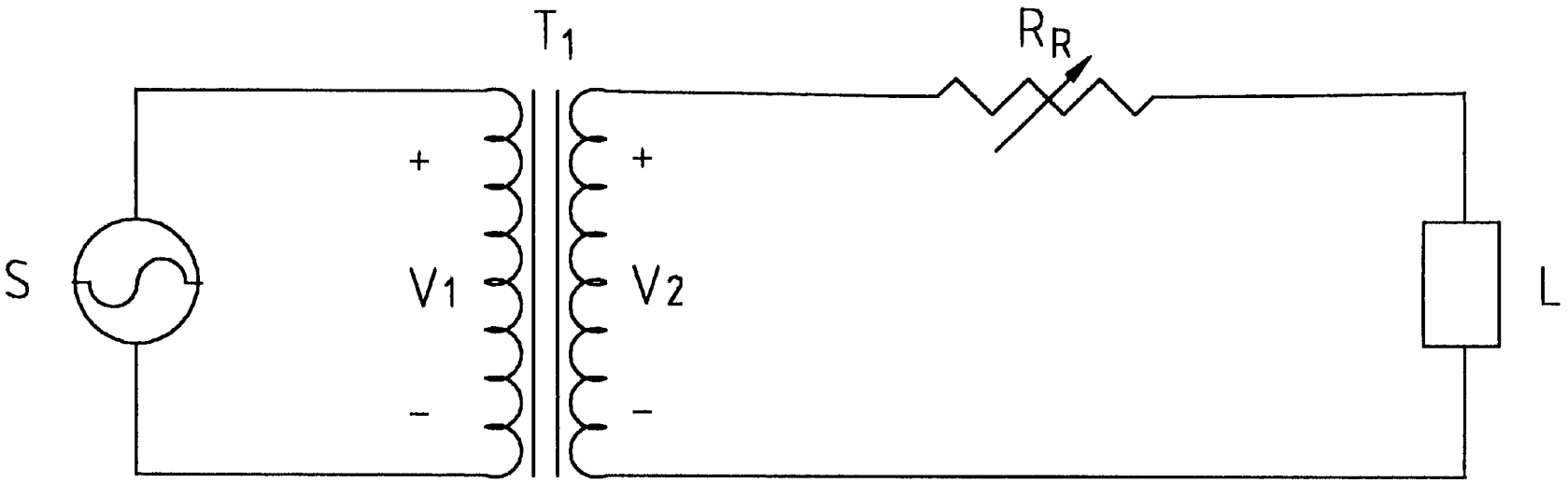
FIG. 1 (PRIOR ART)
FIG. 1 is a schematic diagram of a typical prior art power supply circuit for an illumination lamp in a microscope.

A typical prior art power supply circuit is shown in schematic form in FIG. 1. The circuit comprises alternating current source S, step-down transformer $T_1$, rheostat $R_R$, and load (lamp) L. Assuming the source produces $V_1$=120 VAC @ 60 Hz, and the step-down transformer reduces the voltage to $V_2$=7.5 VAC, the rheostat varies the voltage drop across the load. As the rheostat resistance is dialed to a minimum value, Ohm's Law dictates that progressively more voltage appears across the lamp terminals and as the rheostat resistance approaches its minimum value, the lamp approaches its brightest output. Conversely, as the rheostat resistance increases, the voltage across the terminals of the lamp decreases and the lamp dims.

Figure 2:
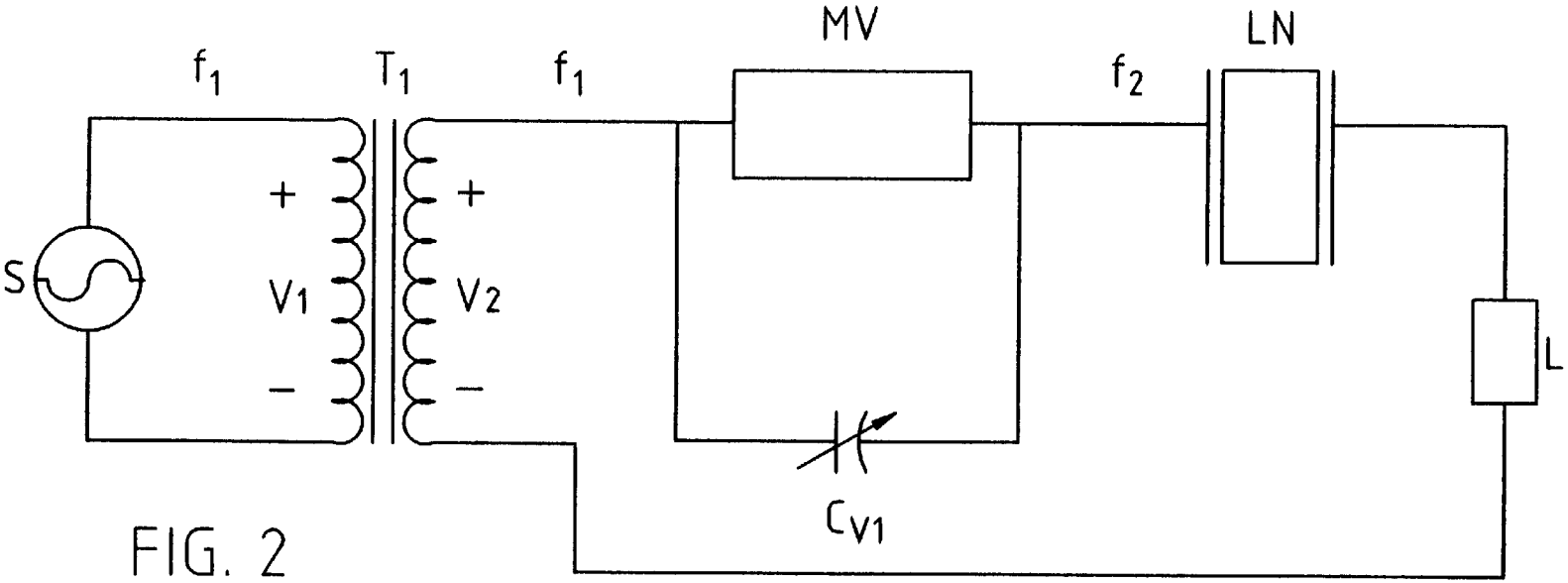
FIG. 2 is a schematic diagram of a first embodiment of a power supply circuit of the invention.

A first embodiment of the present invention replaces the rheostat with a piezoelectric crystal and associated control circuitry. As shown in FIG. 2, the control circuit comprises a source of alternating current S at voltage $V_1$ and frequency $f_1$ (typically 120 or 240 VAC at 60 Hz), step-down transformer $T_1$, which reduces the voltage to $V_2$, chopper circuit MV and $C_{v1}$ which increases the driving frequency to $f_2$ (typically of the order 1.65 MHz), lithium niobate crystal LN, and lamp load L. The chopper frequency $f_2$ is nominally set to the resonant frequency of the crystal, and variable capacitor $C_{v1}$ tunes multivibrator MV to match the resonant frequency or to produce a frequency above or below the resonant frequency. Although a bistable multivibrator is used in a preferred embodiment, other types of chopper devices can be used as well. Also, in this first embodiment, a lithium niobate crystal was used and calculations infra are based on the physical constants associated with lithium niobate. It should be appreciated, however, that other piezoelectric crystals could also be used in the control circuit of the invention.

Figure 3:
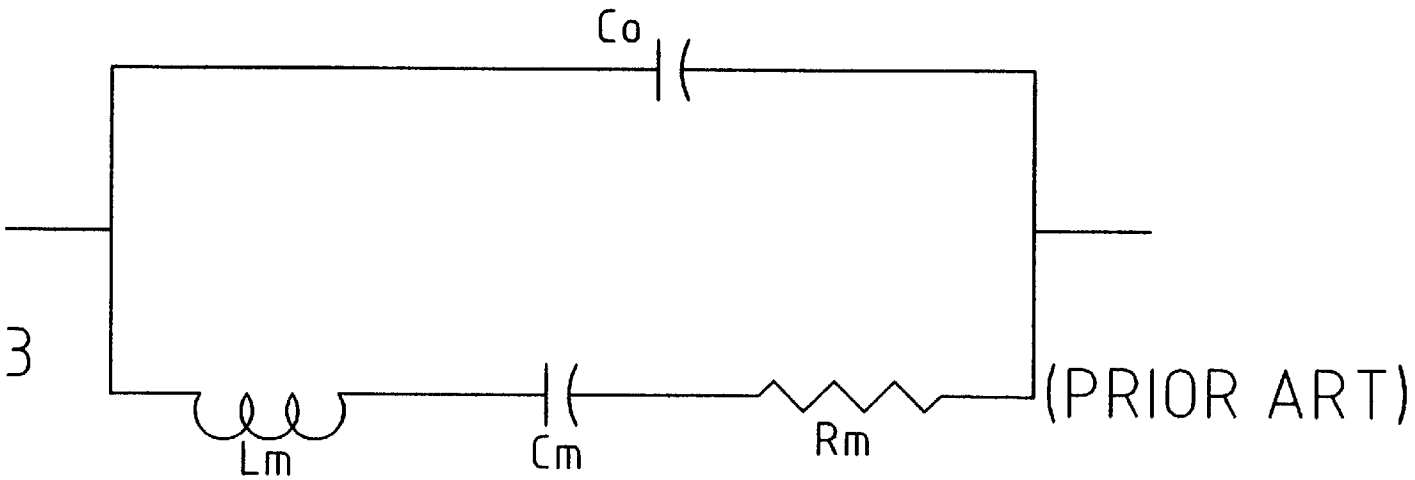
FIG. 3 is an equivalent circuit of the lithium niobate crystal circuit element shown in FIG. 2.

As is well known, the resonant response characteristic as a function of frequency of quartz, lithium niobate, lithium tantalate and a host of other like materials can be modeled as an equivalent circuit. In this equivalent circuit model, the static capacitance, $C_o$, of the fundamental unit is added to motional capacitance, $C_M$, inductance, $L_m$, and resistive $R_m$ terms as shown in FIG. 3. "Introduction to Quartz Crystal Unit Design", Virgil E. Bottom, Van Nostrand Reinhold, 1982, pg. 87. where, $R_m$=motional resistance, typically only a few microohms, usually neglected in calculations $C_m$=motional capacitance $L_m$=motional inductance For fundamental mode resonance the piezoelectric material will then have an electrical behavior governed by the equations:

$$C_0 = k\varepsilon_0 A/t$$

$$R_m = R = \frac{t^3 r}{8A\varepsilon^2}$$

$$L_m = \frac{e^3 \rho}{8A\varepsilon^2}$$

-continued $$C_m = \frac{8A\varepsilon^2}{\pi^2 tc}$$

Where:

A is the area of the electrode on the piezoelectric device t is the blank thickness $\epsilon 0$ is the susceptibility of free space, $8.85\times10^{12}C^2/N\times m^2$ k is the dielectric constant ρ is the density of the piezoelectric material ϵ Is the piezoelectric stress constant of the material c is the piezoelectric elastic constant of the material Assuming a blank thickness of 0.0815", corresponding to a nominal resonant frequency of 1.65 MHz, the impedance of the lithium niobate chip as a function of frequency can be calculated as follows. The capacitive and inductive reactance terms for the static and motional components are:

$$X_0(f) = \frac{-1}{2\pi f C_0}$$

$$X_m(f) = \frac{-1}{2\pi f C_m} + XL_m$$

where the motional inductive reactance is $XL_m = 2\pi f L_m$

The impedance of the crystal is then modeled as:

$$X_{crystal} = X_0(f) \times \frac{R^2 + X_m(f) \times (X_0(f) + X_m(f)}{R^2 + (X_0(f) + X_m(f))^2}$$

(Equations from "Introduction to Quartz Crystal Unit Design", Virgil E. Bottom, Van Nostrand Reinhold, 1982.)

Figure 4:
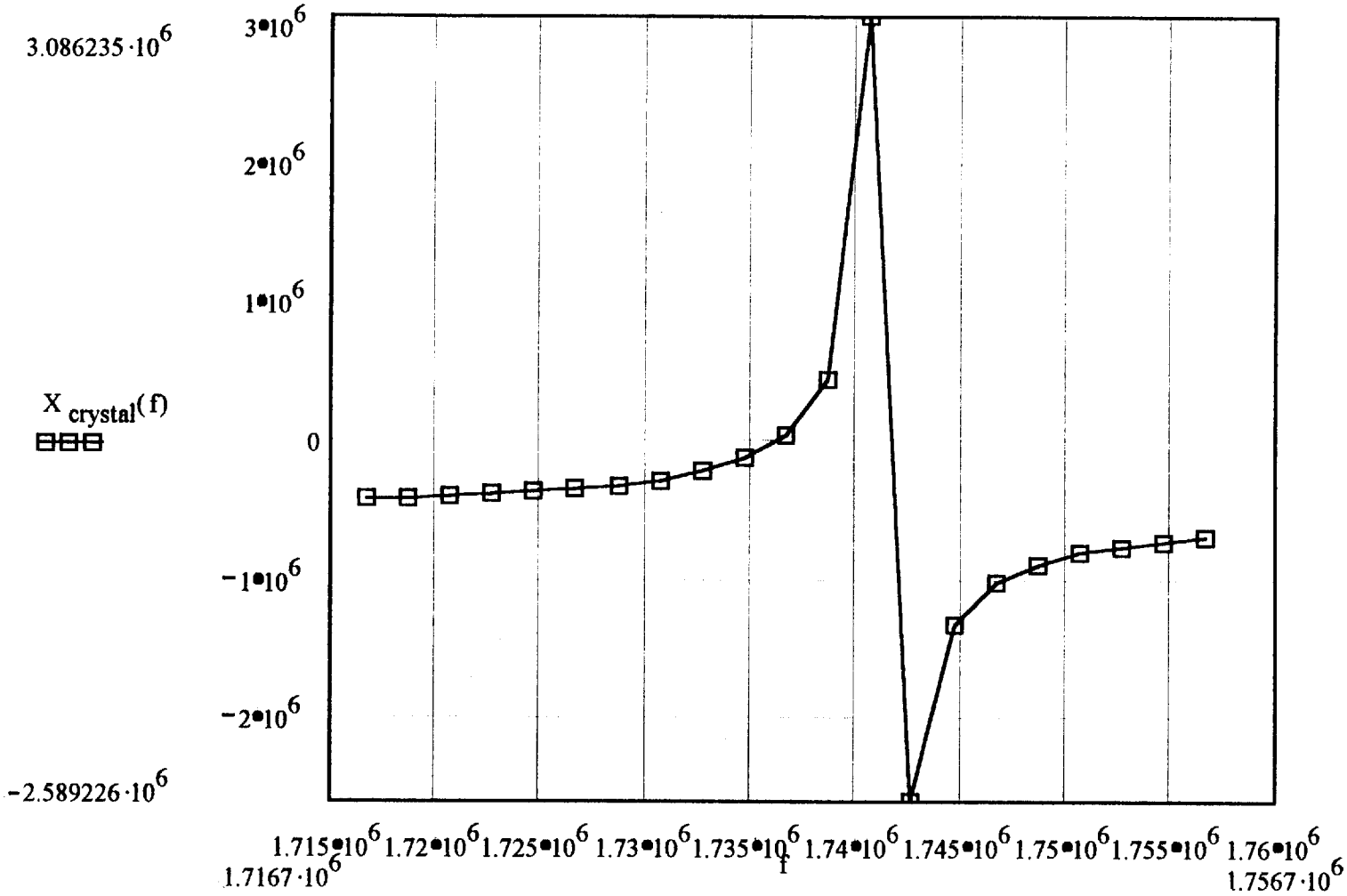
FIG. 4 is a plot of a frequency response curve for a lithium niobate crystal.

The response curve as a function of frequency is shown in FIG. 4.

From this example, it is clear that, at resonance, the inductive and capacitive reactance terms exactly cancel each other out and only the ohmic term is left, typically a value of 2 to 6 ohms. At the anti-resonance point, the impedance is essentially infinite and as a matter of practice, is usually of the order of several megaohms.

Figure 5A:
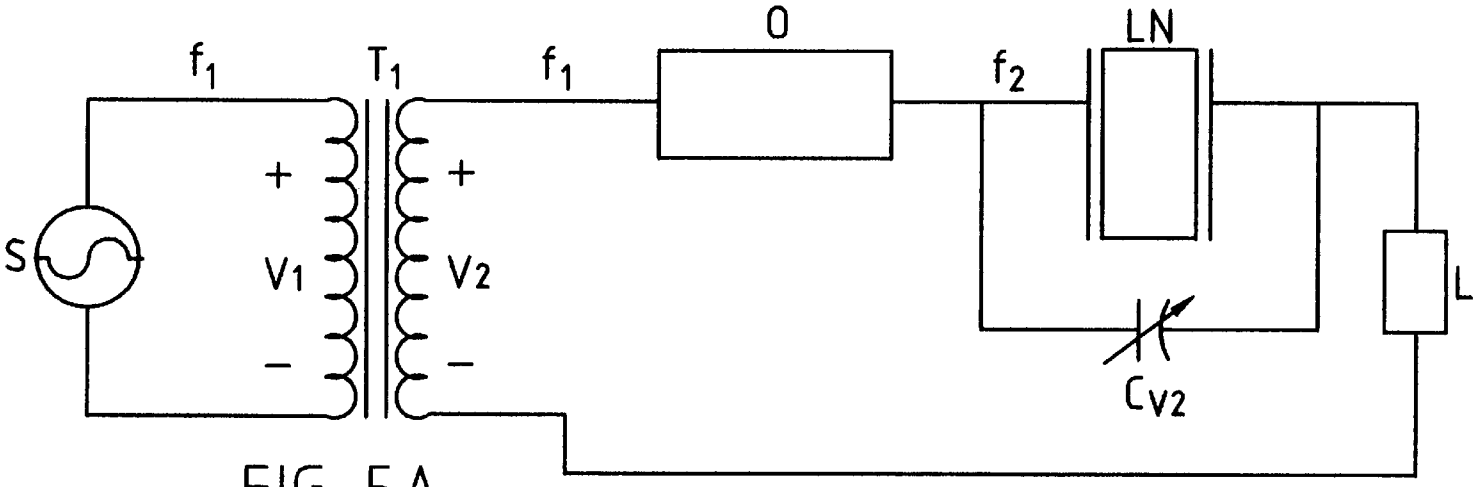
FIG. 5A is a schematic diagram of a second embodiment of a power supply circuit of the invention having a variable capacitor coupled to the piezoelectric crystal; and, FIG. 5B is a schematic diagram of a second embodiment of a power supply circuit of the invention having a variable inductor coupled to the piezoelectric crystal.
Figure 5B:
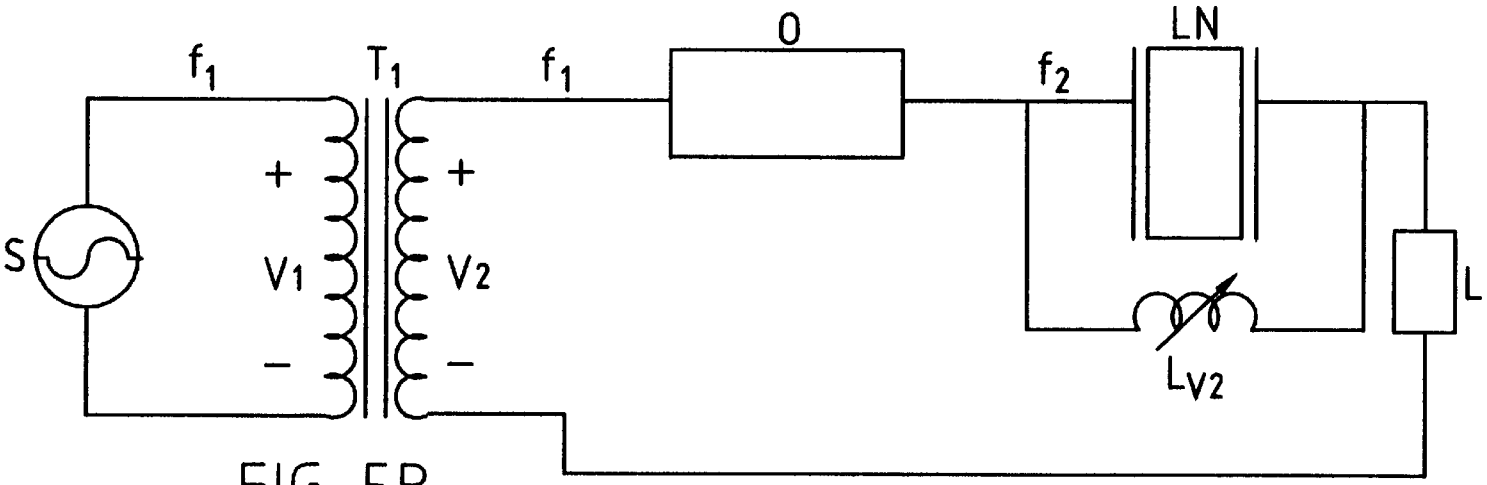

An even more practical variant of this concept is to set the frequency of the chopping or frequency conversion circuitry at a convenient value and then simply shift the natural resonance point of the lithium niobate chip by changing the external load. In most cases, it is preferred to use a variable external ancillary (dummy) load capacitor as this results in less wasted electrical power dissipation, but an external load inductor could be used as well. An example of this second embodiment control circuit using a variable capacitive load is shown in FIG. 5A, and an example using an inductive load is shown in FIG. 5B. In these embodiments, O represents the oscillator which chops the input signal having frequency $f_1$ into a signal having a frequency $f_2$. This second frequency is set to approximate the resonant frequency of the crystal LN. Varying the capacitive or inductive loads $C_{v2}$ and $L_{v2}$ in these two circuits functions to dim the lamps.

Figure 6:
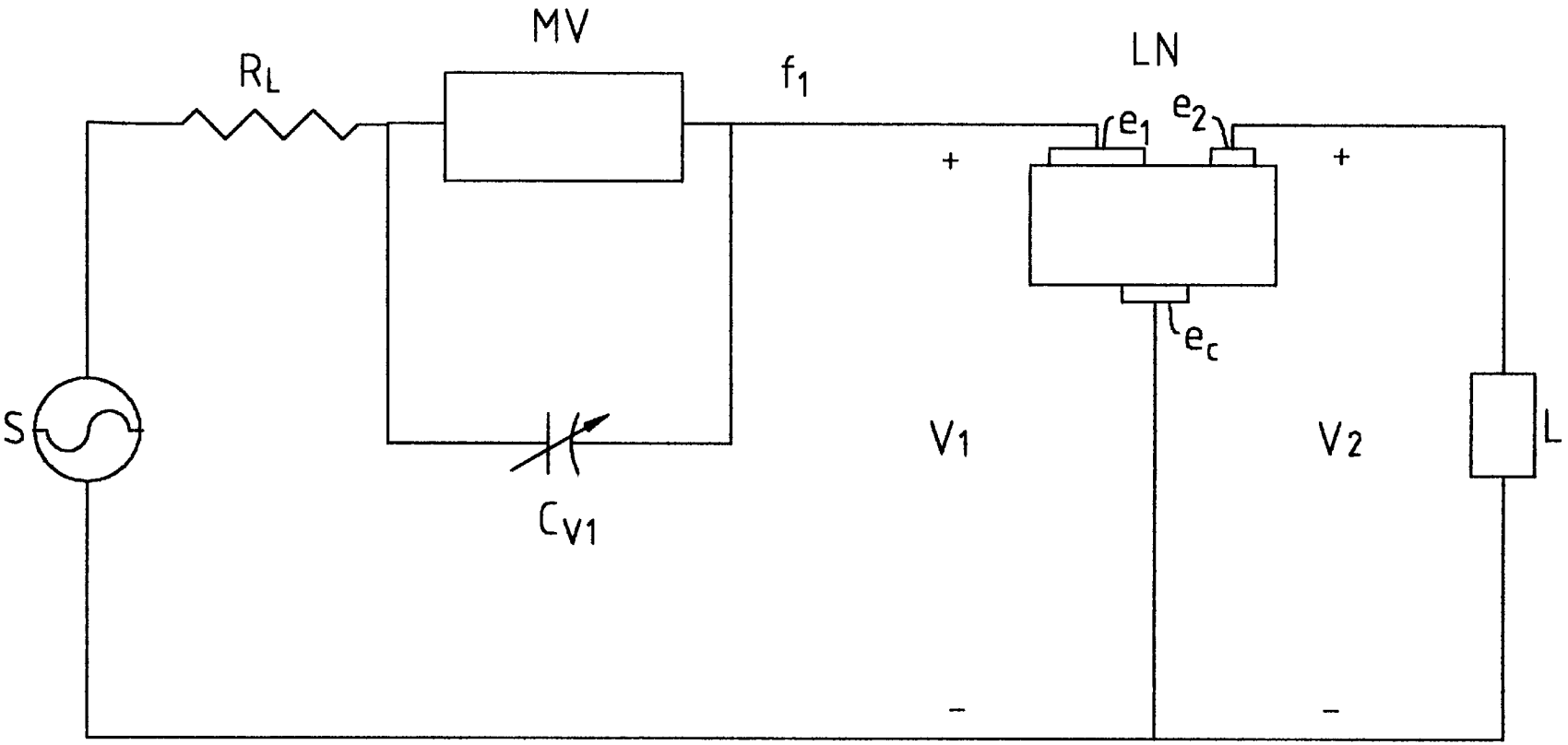
FIG. 6 is a schematic diagram of a third embodiment of a power supply circuit of the invention which uses a piezoelectric crystal and associated circuitry to replace both a transformer and a rheostat in a control circuit for a microscope lamp.

Finally, FIG. 6 illustrates a third embodiment of the control circuit of the invention which replaces both the step-down transformer and the rheostat with a piezoelectric crystal and associated drive circuitry. In this embodiment, the lithium niobate chip is configured with a pair of electrodes on one surface and a common electrode on the opposing face. The ratio of the surface areas of the two electrodes on the first face determines the step-up or step-down voltage ratio.

In this design, as we match the driving electrical frequency to that of the natural resonance frequency of the chip, the electrical coupling from one electrode to its adjacent neighbor becomes more efficient and more voltage appears at the second electrode. The lamp is then connected directly to the second electrode and driven without need of wasting electrical power through a passive load in series with it.

Adverting now to FIG. 6, the third embodiment circuit comprises source S, current limiting resistor $R_L$, chopper circuit MV and $C_{v1}$, lithium niobate crystal LN having first electrode $e_1$, second electrode $e_2$, common electrode $e_c$, and load lamp L. In the circuit shown, the crystal is arranged as a voltage step-down device, with $V_1>V_2$. Control of lamp intensity is accomplished by tuning capacitor $C_{v1}$ to vary driving frequency $f_1$. Again, when the driving frequency matches the resonant frequency of the crystal, the impedance of the crystal is at a minimum, and lamp intensity is at its brightest. As the driving frequency varies from the resonant frequency, the impedance increases and the lamp dims. It should be appreciated that this circuit could easily be configured to operate as a voltage step-up device by reversing the electrode leads. Thus, it is seen that this embodiment replaces both the transformer and rheostat with a piezoelectric crystal and associated drive circuitry.

A typical rheostat used in a microscope lamp control circuit costs about $9.00, whereas the cost of the piezoelectric chip and associated circuitry used in the first two disclosed embodiments costs about $2.00, a savings of nearly 75%. The savings is even greater for the third embodiment, where the transformer is replaced. Moreover, the electronic circuitry is much more reliable and energy efficient than the corresponding rheostat circuit.

It should be appreciated that the present invention is not limited to circuits containing incandescent lamps as loads. In a circuit containing a fluorescent lamp, for example, the circuit of the present invention can be used to replace the inductive coil in the ballast circuit with the piezoelectric crystal of the present invention. By varying the impedance of the crystal as described earlier, the fluorescent lamp can be dimmed.

Thus it is seen that the objects of the invention are efficiently attained. Modifications of the invention should be readily apparent to those having ordinary skill in the art, and the three disclosed embodiments are not intended to limit the scope of the invention as claimed.

What I claim is:

1. A piezoelectric illumination control circuit for a microscope, comprising:

a tunable frequency source of alternating current;

a piezoelectric crystal having an impedance dependent on operating frequency, driven by said tunable frequency source of alternating current; and, a load driven by said piezoelectric crystal.

2. A piezoelectric illumination control circuit for a microscope as recited in claim 1 wherein said load is a lamp.

3. A piezoelectric illumination control circuit for a microscope as recited in claim 2 wherein said lamp is an incandescent lamp.

4. A piezoelectric illumination control circuit for a microscope as recited in claim 2 wherein said lamp is a fluorescent lamp.

5. A piezoelectric illumination control circuit for a microscope as recited in claim 1 wherein said piezoelectric crystal is a lithium niobate crystal.

6. A piezoelectric illumination control circuit for a microscope as recited in claim 5 wherein said lithium niobate crystal has a known resonant frequency, and said impedance is a minimum when said crystal is operated at said known resonant frequency.

7. A piezoelectric illumination control circuit for a microscope as recited in claim 6 wherein said impedance increases as the operating frequency increases above said known resonant frequency.

8. A piezoelectric illumination control circuit for a microscope as recited in claim 1 wherein said piezoelectric crystal is a quartz crystal.

9. A piezoelectric illumination control circuit for a microscope as recited in claim 1 wherein said piezoelectric crystal is a lithium tantalate crystal.

10. A piezoelectric illumination control circuit for a microscope as recited in claim 1 wherein said tunable frequency source of alternating current is a bistable multivibrator operated by a source of alternating current.

11. A piezoelectric illumination control circuit for a microscope as recited in claim 1 wherein said tunable frequency source of alternating current is a chopper circuit.

12. A piezoelectric illumination control circuit for a microscope, comprising:

a constant frequency source of alternating current;

a piezoelectric crystal coupled to a tunable dummy reactive load for the purpose of varying the impedance of said crystal and dummy load, said piezoelectric crystal driven by said constant frequency source of alternating current; and, a load driven by said piezoelectric crystal.

13. A piezoelectric illumination control circuit for a microscope as recited in claim 12 wherein said piezoelectric crystal is a lithium niobate crystal.

14. A piezoelectric illumination control circuit for a microscope as recited in claim 12 wherein said tunable dummy reactive load is a tunable capacitor.

15. A piezoelectric illumination control circuit for a microscope as recited in claim 12 wherein said tunable dummy reactive load is a tunable inductor.

16. A piezoelectric illumination control circuit for a microscope as recited in claim 12 wherein said load is a lamp.

17. A piezoelectric illumination control circuit for a microscope as recited in claim 12 wherein said constant frequency source of alternating current is arranged to operate at a known resonant frequency of said piezoelectric crystal.

18. A control circuit for varying current supplied to a load, comprising:

a tunable frequency source of alternating current;

a piezoelectric crystal having an impedance dependent on operating frequency, said piezoelectric crystal driven by said tunable frequency source of alternating current; and, a load driven by said piezoelectric crystal.

19. A piezoelectric control circuit for a lamp in a microscope, comprising:

a tunable frequency source of alternating current;

a piezoelectric crystal having an impedance dependent on operating frequency, said crystal having a first, second and common electrode, said first electrode having a surface area which is different than a surface area of said second electrode, wherein a first voltage impressed across said first and common electrodes produces a second voltage, different in magnitude than said second voltage, across said second and common electrodes, where said lamp is connected across said second and common electrodes.

20. A piezoelectric control circuit for a lamp in a microscope as recited in claim 19 wherein said first electrode surface area is greater than said second electrode surface area and said first voltage is greater in magnitude than said second voltage.

21. A piezoelectric control circuit for a lamp in a microscope as recited in claim 19 wherein said first electrode surface area is less than said second electrode surface area and said first voltage is lesser in magnitude than said second voltage.

22. A piezoelectric control circuit for a lamp in a microscope as recited in claim 19 wherein said piezoelectric crystal is lithium niobate.

23. A piezoelectric control circuit for a load, comprising:

a constant frequency source of alternating current;

a piezoelectric crystal coupled to a tunable dummy reactive load for the purpose of varying the impedance of said crystal and dummy load, said piezoelectric crystal driven by said constant frequency source of alternating current; and, a load driven by said piezoelectric crystal.

* * * * *